US006538539B1

(12) United States Patent
Lu

(10) Patent No.: US 6,538,539 B1
(45) Date of Patent: Mar. 25, 2003

(54) REMOTELY SWITCHABLE CIRCUIT BREAKER

(75) Inventor: Hsueh-Tsung Lu, Taoyuan (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 10/065,299

(22) Filed: Oct. 1, 2002

(65) Prior Publication Data

(65)

(30) Foreign Application Priority Data

Aug. 15, 2002 (TW) ..... 91212662 U

(51) Int. Cl.[7] ..... H01H 75/00; H01H 3/20

(52) U.S. Cl. ..... 335/6; 200/331; 200/332; 200/337

(58) Field of Search ..... 335/6, 11, 202, 335/203; 200/330, 331, 332, 337

(56) References Cited

U.S. PATENT DOCUMENTS 5,838,219 A * 11/1998 Du et al. ..... 335/14

* cited by examiner

*Primary Examiner*—Ramon M. Barrera
(74) *Attorney, Agent, or Firm*—Jianq Chyun IP Office

(57) ABSTRACT

A remotely switchable circuit breaker mounted in the casing of an electrical device comprises a circuit breaker unit, provided with a switching paddle, and a remote switching mechanism connected to the switching paddle. The remote switching mechanism comprises a connecting rod that pivotally connects a remote switch and rotatably and slidably connects the paddle. The remote switch, including a key button, is pivotally fastened with the casing via a first fastening base. The connecting rod is further rotatably and slidably fastened with the casing via a second fastening base. A pressing action on the key button causes a rotation and slide of the connecting rod that actuates a switching movement of the paddle of the circuit breaker unit.

10 Claims, 7 Drawing Sheets

REMOTELY SWITCHABLE CIRCUIT BREAKER

CROSS REFERENCE TO RELATED APPLICATIONS

This application claims the priority benefit of Taiwan application serial no. 91212662, filed Aug. 15, 2002.

BACKGROUND OF INVENTION

1. Field of the Invention

The invention relates generally to a circuit breaker and, more particularly, to a remotely switchable circuit breaker.

2. Description of the Related Art

The power supply of electrical equipment generally includes a power breaker that enables a user to manually switch the electrical state of the power supply. The construction of a power supply is diversified into many types according to the specific functional requirements of the electrical equipment to which the power supply is associated. These specific functional requirements may be distinguished between, for example, the need of low operating voltage such as in conventional desktop computers, or the need of high operating voltage for other types of specific electrical equipment. As the design of the electrical power supply becomes more sophisticated, some structures may even include two power breakers respectively coupled with the input and the output of the power supply in order to improve its control.

A traditional circuit breaker commonly used as a power breaker is the so-called "paddle type" power breaker. This type of power breaker usually has a switching paddle the actuation of which switches on or switches off the power breaker. Besides paddle type circuit breakers, another type of circuit breaker known in the prior art is called the "rock type" circuit breaker. However, because this latter is dedicated to specific and not common applications, it will be not considered herein.

FIG. 1 is a perspective view that schematically illustrates a paddle type circuit breaker known in the prior art. FIG. 2 is a perspective view that schematically illustrates the mount of the known circuit breaker in a casing. As illustrated, a circuit breaker 100 traditionally comprises a paddle 102 the actuation of which switches an operating mode. To allow a user's manipulation of the paddle, the circuit breaker 100 is conventionally mounted in immediate proximity of a front side of the casing 200 so that the paddle 102 protrudes outside the casing 200. Such a required mount of the circuit breaker 100 is not flexible, and the protrusion of the paddle 102 on the front side of the casing 200 requires a non-negligible space. Moreover, the signals received by the circuit breaker 100 are usually delivered from a rear side of the casing 200 opposite to the front side where the circuit breaker 100 is placed. A resulting long electrical wiring to the circuit breaker 100 therefore may easily produce undesirable electromagnetic interferences.

SUMMARY OF INVENTION

An aspect of the invention is therefore to provide a remotely switchable circuit breaker that allows a flexible mount of the circuit breaker within the casing of an electrical device.

Another aspect of the invention is to provide a remotely switchable circuit breaker that further allows a reduction of the electrical wiring length of the circuit breaker within the electrical device so that the electromagnetic interferences are reduced.

Furthermore, another aspect of the invention is to provide a remotely switchable circuit breaker that can be implemented in a power supply as a remotely switchable power breaker.

Yet, another aspect of the invention is to provide a remote switching mechanism that is connected to a switching paddle of an electrical device in a manner to be capable of remotely switching the operating mode of the electrical device via an actuation of the switching paddle.

To accomplish the above and other objectives, a remotely switchable circuit breaker of the invention is mounted in a casing of an electrical device. The remotely switchable circuit breaker comprises a circuit breaker unit, provided with a switching paddle the actuation of which switches an operating mode of the electrical device, and a remote switching mechanism connected to the paddle of the circuit breaker unit. The remote switching mechanism extends outside the casing in a key button which a user presses to remotely actuate the switching paddle. When the user presses on the key button, the remote switching mechanism converts the pressing action to an actuation of the paddle of the breaker unit.

In accordance with the above and other objectives, the remote switching mechanism comprises first and second fastening bases, a remote switch, and a connecting rod. The first fastening base pivotally attaches the remote switch to the casing, and the second fastening base rotatably and slidably attaches the connecting rod to the casing. A first end of the connecting rod further pivotally connects the remote switch and an opposite second end of the connecting rod rotatably and slidably connects the paddle of the circuit breaker. The remote switch further includes a key button that is externally exposed on a peripheral side of the casing.

In accordance with the above and other objectives, the remote switch comprises a key button and two hinges through which the remote switch respectively connects pivotally the first fastening base and the connecting rod.

In accordance with the above and other objectives, the connection between the connecting rod and the second fastening base is achieved by means a rotatable and slidable engagement of a projection of the connecting rod through a slot of the second fastening base.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION

Figure 1:
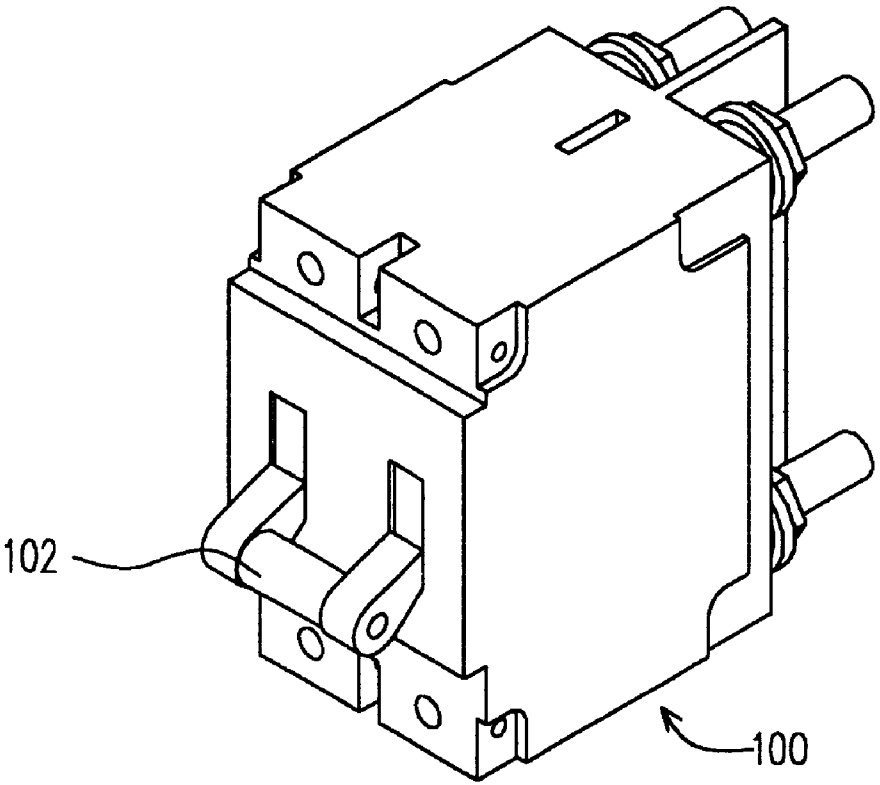
FIG. 1 (PRIOR ART)
FIG. 1 is a perspective view of a conventional circuit breaker.
Figure 2:
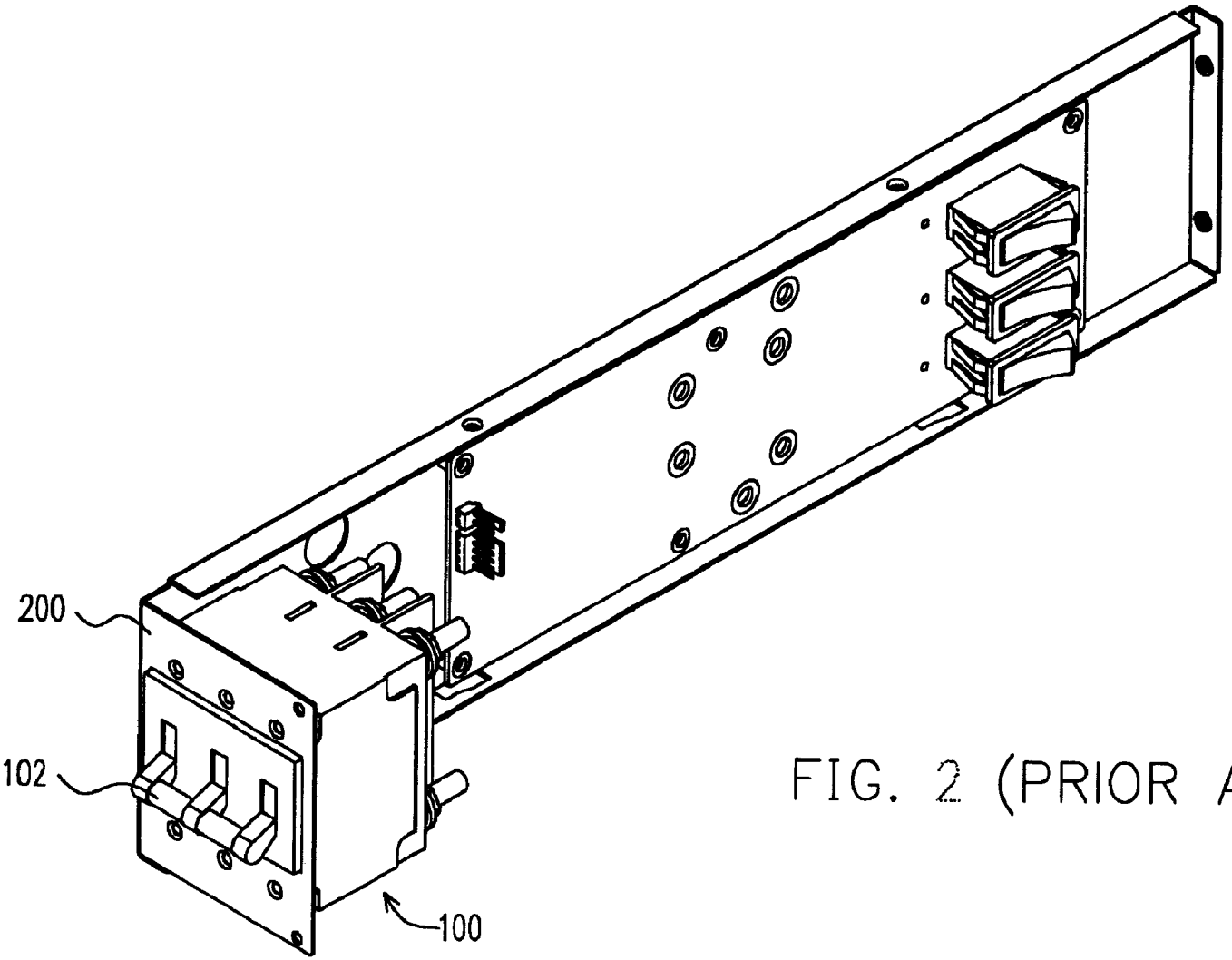
FIG. 2 (PRIOR ART)
FIG. 2 is a perspective view schematically illustrating the mount of a conventional circuit breaker in the casing of an electrical device.

The following detailed description of the embodiments and examples of the present invention with reference to the accompanying drawings is only illustrative and not limiting. Furthermore, wherever possible in the description, the same reference symbols will refer to similar elements and parts unless otherwise illustrated in the drawings.

The invention provides a remotely switchable circuit breaker that is capable of switching the operating mode of an electrical device. The embodiment herein describes an exemplary and not limited application of the remotely switchable circuit breaker device in, for example, a power supply as a remotely switchable power breaker.

In order to quantify the output state of a power supply (voltage, current, phase), a monitoring device, such as a monitor screen, is usually mounted to the casing of the power supply to ensure that no abnormal events occur. Because the switching paddle length of the conventional power breaker is limited, the conventional power breaker therefore must be usually mounted close to a peripheral (front) side of the casing so that the paddle protrudes outside the casing to allow a user's manipulation. Such a mount of the conventional power breaker takes up substantial space of the peripheral side of the casing, which is detrimental to the mount of the monitoring device. An aspect of the invention is therefore to provide a remotely switchable power breaker that can overcome the above problems.

Figure 3A:
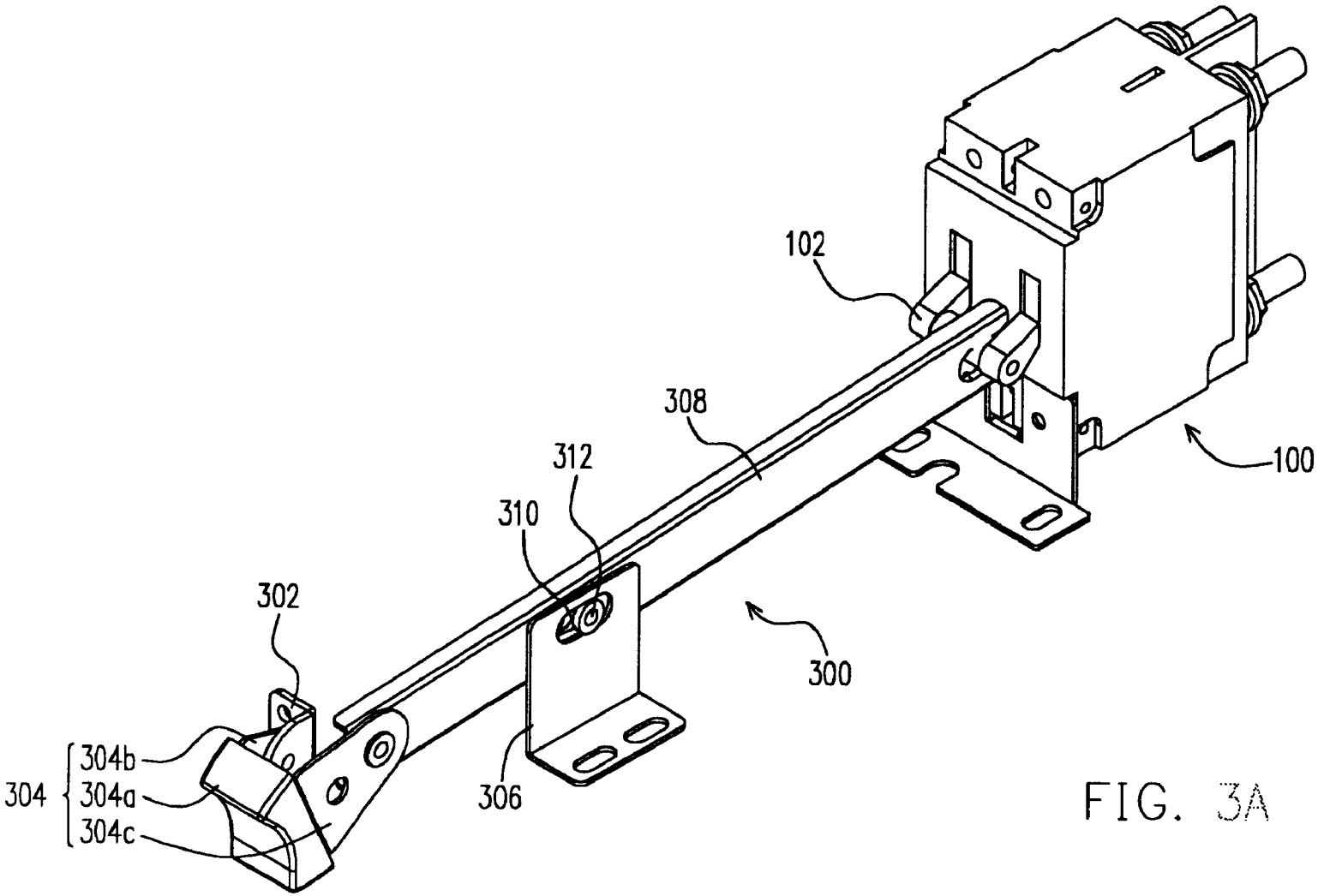
FIG. 3A is a perspective view of a remotely switchable circuit breaker according to an embodiment of the invention
Figure 3B:
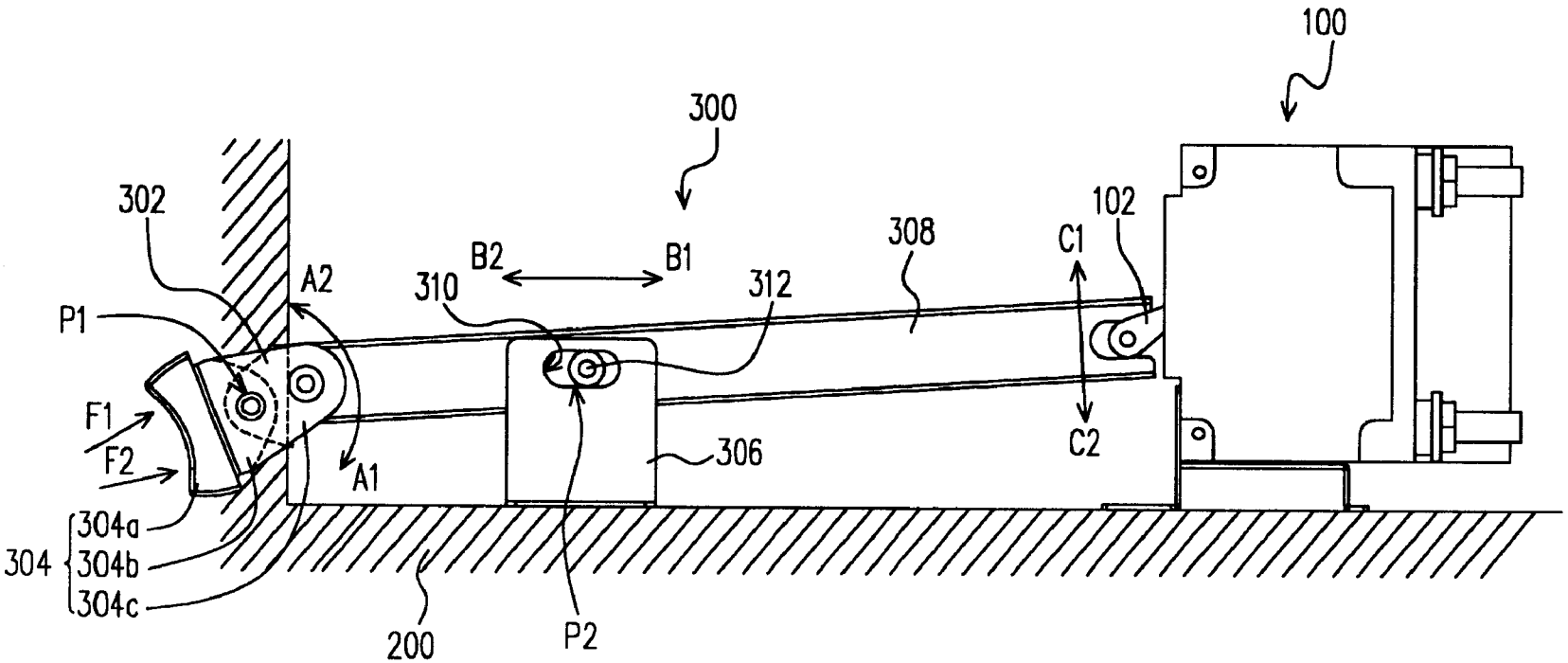
FIG. 3B is a schematic side view of the remotely switchable circuit breaker of FIG. 3A.
Figure 4:
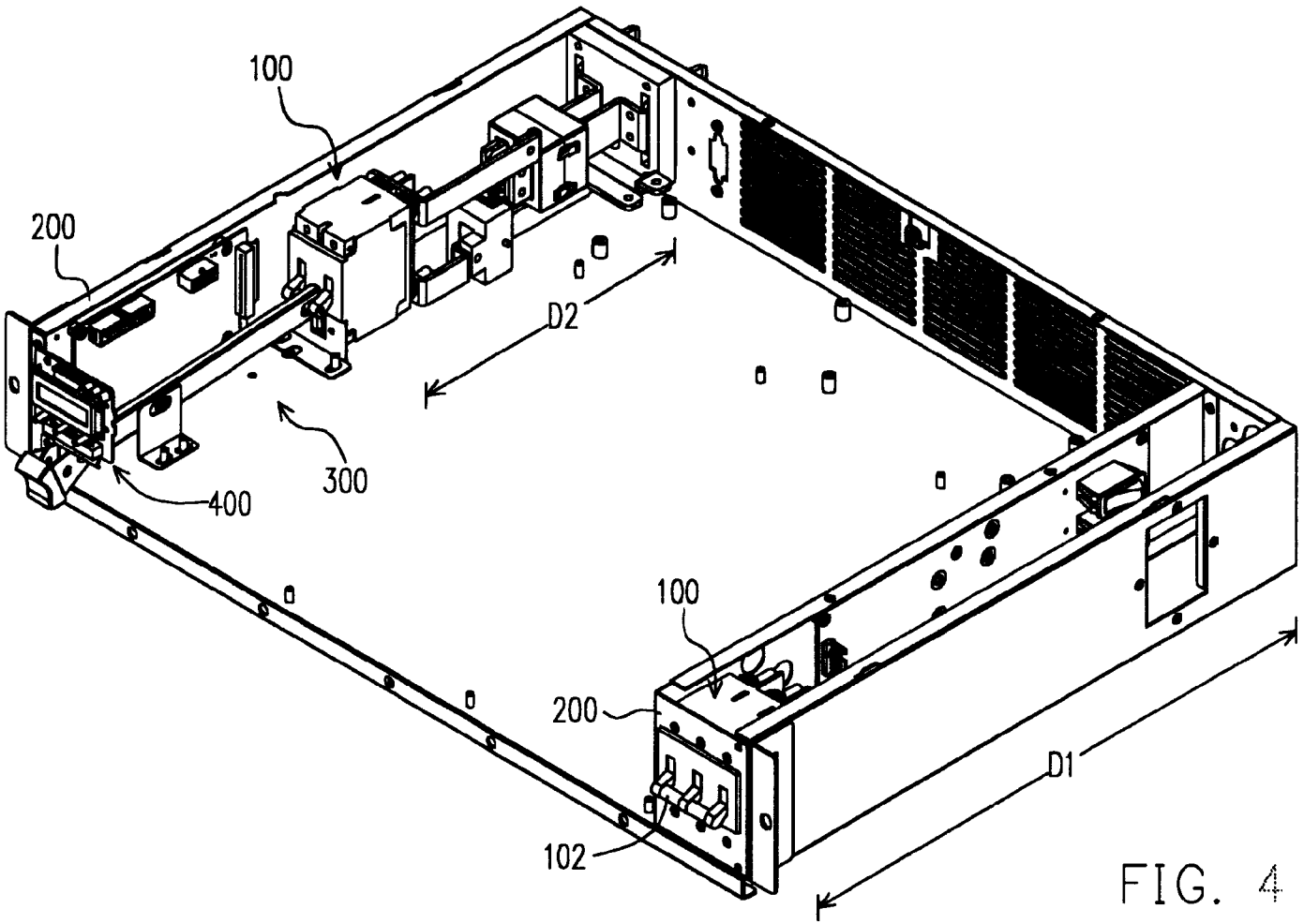
FIG. 4 is a perspective view schematically illustrating the mount of a remotely switchable circuit breaker in the casing of an electrical device according to an embodiment of the invention.

FIG. 3A and FIG. 3B are respectively a perspective view and a side view of a remotely switchable power breaker according to an embodiment of the invention. FIG. 4 is a perspective view schematically showing a remotely switchable power breaker mounted within the casing of a power supply according to an embodiment of the invention.

As illustrated in FIG. 4, a remotely switchable power breaker of the invention comprises a power breaker unit, such as a traditional power breaker 100, and a remote switching mechanism 300 that are arranged within a casing 200 of the power supply. The breaker unit 100 is provided with a switching paddle 102 (see FIG. 3A) actuation of which switches an operating mode of the power supply. The breaker unit 100 may be placed at various adequate locations within the casing 200, and is not required to be close to a peripheral side of the casing 200. Although the paddle 102 does not protrude outside the casing 200, a user however can switch the operating mode of the power supply by means of the remote switching mechanism 300 construction of which, according to one embodiment of the invention, is as follows.

The remote switching mechanism 300 comprises, for example, a first fastening base 302, a remote switch 304, a second fastening base 306, and a connecting rod 308. The first fastening base 302 pivotally connects the remote switch 304 and further is fixedly attached to the casing 200. The second fastening base 306 rotatably and slidably connects the connecting rod 308 and further is fixedly attached to the casing 200 at a location between the first fastening base 302 and the breaker unit 100. A first end of the connecting rod 308 pivotally connects the remote switch 304 and an opposite second end of the connecting rod 308 rotatably and slidably connects the paddle 102.

The remote switch 304 comprises, for example, a key button 304*a* and first and second hinge 304*b*, 304*c*. The key button 304*a* pivotally connects respectively the first fastening base 302 via the first hinge 304*b*, and the connecting rod 308 via the second hinge 304*c*.

The connection between the connecting rod 308 and the second fastening base 306 is achieved by means of a projection 312 of the connecting rod 308 that rotatably and slidably engages a guiding slot 310 of the second fastening base 306.

Referring to FIG. 3B, the connection of the first fastening base 302 to the remote switch 304 at the second hinge 304*c* is designated P1, and the connection of the connecting rod 308 to the second fastening base 306 is designated P2. When a user exerts a pressing force F1 on the remote switch 304, a consequent rotation of the remote switch 304 around P1 drives a rotation of the first end of the connecting rod 308 along a direction A1. Via its connection P2 to the second fastening base 306, the connecting rod 308 consequently effectuates a rotating and sliding (along direction B1 of the guiding slot 310) movement that causes its second end to drive a movement of the paddle 102 along the direction C1. An on-switch (or off-switch) is thereby achieved.

When the user exerts a pressing force F2 on the remote switch 304, a consequent rotation of the remote switch 304 around P1 drives a rotation of the first end of the connecting rod 308 along a direction A2 opposite to A1. The connecting rod 308 consequently effectuates a rotating and sliding (along B2) movement that causes its second end to drive a movement of the paddle 102 along a direction C2 opposite to C1. An off-switch (or on-switch) is thereby achieved.

FIG. 4 illustrates a remotely switchable power breaker mounted in the casing of a power supply according to an embodiment of the invention and a traditional power breaker mounted in the casing according to a manner known in the prior art. As shown, the conventional mount of a traditional power breaker (strictly consisting of the power breaker unit 100) in the casing 200 leaves a substantial spacing distance D1 between the traditional breaker and a rear side (signal output side) of the casing 200. In contrast, the mount of the remotely switchable power breaker of the invention leaves a spacing distance D2 between the breaker unit 100 and the rear side of the casing 200 that is smaller than D1, due to the length of the remote switching unit 300. As a result, an electrical wiring length between the breaker unit 100 and the rear side of the casing 200, corresponding to the signal output side, is favorably reduced, which consequently diminishes the electromagnetic interference effects.

Those skilled in the art will readily appreciate that the specific construction of the remote switching mechanism as described above may be modified according to various design requirements without departing from the concepts of the invention.

Figure 5A:
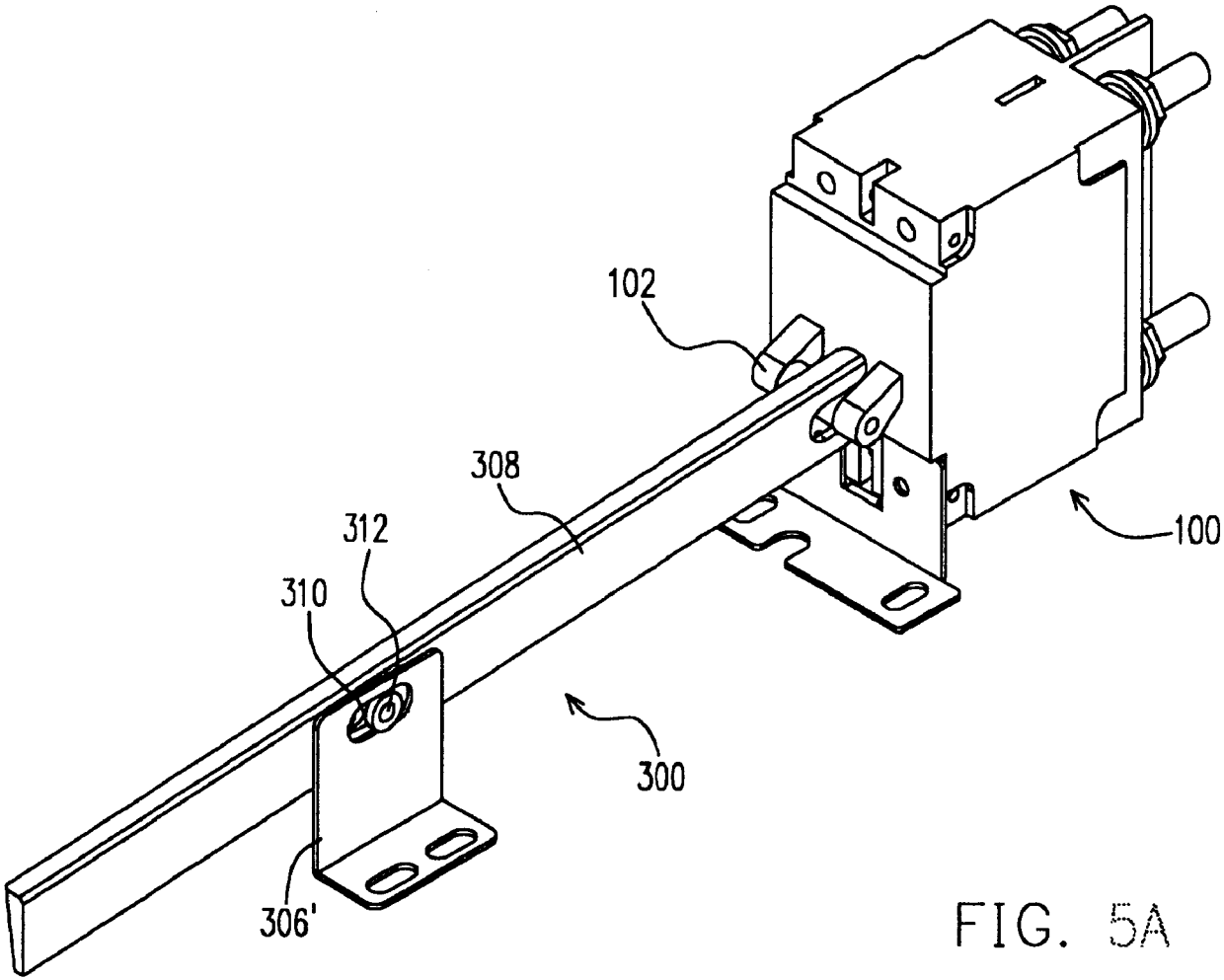
FIG. 5A is a perspective view of a remotely switchable circuit breaker according to another embodiment of the invention.
Figure 5B:
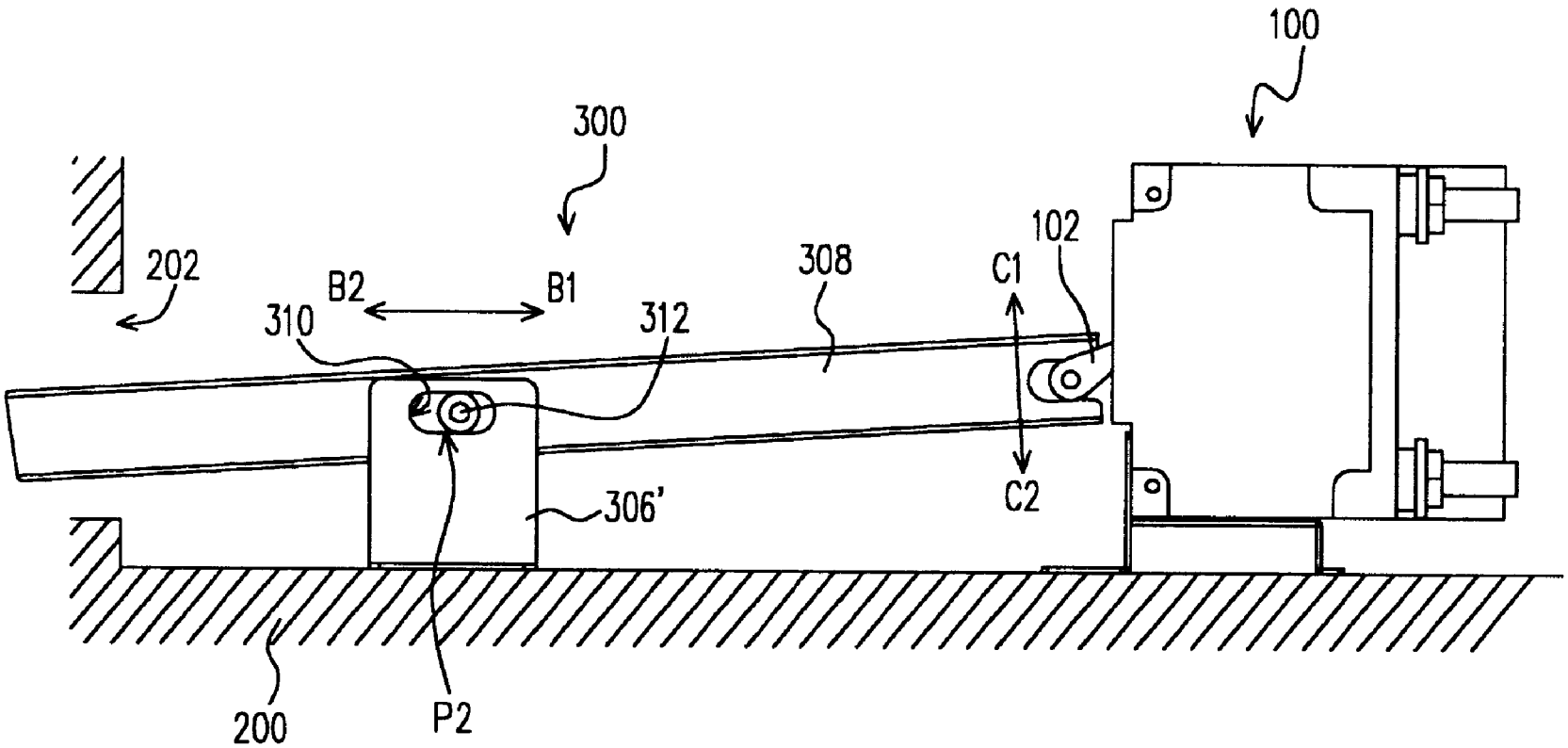
FIG. 5B is a schematic side view of the remotely switchable circuit breaker of FIG. 5A.

FIG. 5A and FIG. 5B are respectively a perspective view and a side view of a remotely switchable circuit breaker according to another embodiment of the invention. As shown, a remote switching mechanism 300 can comprise, for example, a single fastening base 306' and a connecting rod 308. The fastening base 306' is placed at a location between an opening 202 of the casing 200 and the breaker unit 100. A first end of the connecting rod 308 rotatably and slidably connects the paddle 102 and an opposite second end of the connecting rod 308 is externally exposed through the opening 202 of the casing 200. The connection between the fastening base 306' and the connecting rod 308 may be similar to the previous embodiment, achieved via the engagement of the projection 312 of the connecting rod 308 with the guiding slot 310 of the fastening base 306'.

As described above, the remotely switchable power breaker of the invention therefore includes several advantages. By means of the remote switching mechanism, the breaker unit does not need to be mounted close to a peripheral side of the casing to enable the user to achieve a switching operation. In contrast, the breaker unit can be placed at an adequate location that enables the reduction of its electrical wiring length to diminish the electromagnetic interference effects. Moreover, since the specific structure of the remote switching mechanism of the invention is adaptable with any type of circuit breakers, the general structure of the invention is therefore flexibly adapted to any types of electrical devices that are provided with switching paddle elements.

It should be apparent to those skilled in the art that other structures that are obtained from various modifications and variations of different parts of the above-described remotely switchable circuit breaker of the invention would be possible without departing from the scope and spirit of the invention as illustrated herein. Therefore, the above description of embodiments and examples only illustrates specific ways of making and performing the invention that, consequently, should cover variations and modifications thereof, provided they fall within the inventive concepts as defined in the following claims.

What is claimed is:

1. A remotely switchable circuit breaker, arranged within a casing, the remotely switchable circuit breaker comprising:

a circuit breaker unit, placed in the casing and having a switching paddle; and a remote switching mechanism, comprising:

a first fastening base, fixedly attached to the casing;

a remote switch, pivotally connected to the first fastening base, wherein the remote switch rotates under a pressing action from a user;

a second fastening base, fixedly attached to the casing at a location between the first fastening base and the circuit breaker unit; and a connecting rod, pivotally connected to the remote switch and rotatably and slidably connected to both second fastening base and switching paddle of the circuit breaker unit in order to convert the pressing action on the remote switch to a switching displacement of the switching paddle.

2. The remotely switchable circuit breaker of claim 1, wherein the remote switch further includes:

a key button;

a first hinge, connected to the key button; and a second hinge, connected to the key button, wherein the key button pivotally connects both the first fastening base and connecting rod respectively through the first hinge and the second hinge.

3. The remotely switchable circuit breaker of claim 1, wherein the second fastening base includes a guiding slot through which a projection of the connecting rod rotatably and slidably engages.

4. A remote switching mechanism, mounted to a switching paddle of an electrical device in order to remotely switch an operating mode of the electrical device, the electrical device being enclosed in a casing, the remote switching mechanism comprising:

a first fastening base, fixedly attached to the casing;

a remote switch, pivotally connected to the first fastening base, wherein the remote switch rotates under a pressing action from a user;

a second fastening base, fixedly attached to the casing at a location between the first fastening base and the electrical device; and a connecting rod, pivotally connected to the remote switch and rotatably and slidably connected to both second fastening base and switching paddle of the electrical device in order to convert the pressing action on the remote switch to a switching displacement of the switching paddle for switching the electrical device.

5. The mechanism of claim 4, wherein the remote switch further includes:

a key button;

a first hinge, connected to the key button; and a second hinge, connected to the key button, wherein the key button pivotally connects both first fastening base and connecting rod respectively through the first hinge and the second hinge.

6. The mechanism of claim 4, wherein the second fastening base includes a guiding slot through which a projection of the connecting rod rotatably and slidably engages.

7. A remotely switchable circuit breaker, arranged in a casing having an opening, the remotely switchable circuit breaker comprising:

a circuit breaker unit, placed in the casing and having a switching paddle; and a remote switching mechanism, comprising:

a fastening base, fixedly attached to the casing at a location between the circuit breaker unit and the opening of the casing; and a connecting rod, movably connected to the fastening base, the connecting rod having a first end rotatably and slidably connected to the switching paddle of the circuit breaker unit and a second end externally exposed through the opening of the casing in order to remotely actuate a switching displacement of the paddle.

8. The circuit breaker of claim 7, wherein the movable connection between the connecting rod and the fastening base is achieved via a rotatable and slidable engagement of a projection of the connecting rod with a guiding slot of the fastening base.

9. A remote switching mechanism, mounted to a switching paddle of an electrical device in order to remotely switch an operating mode of the electrical device, the electrical device being enclosed in a casing having an opening, the remote switching mechanism comprising:

a fastening base, fixedly attached to the casing at a location between the switching paddle and the opening of the casing; and a connecting rod, movably connected to the fastening base, the connecting rod having a first end rotatably and slidably connected to the switching paddle of the electrical device and a second end externally exposed through the opening of the casing in order to remotely actuate the switching paddle for switching the electrical device.

10. The remote switching mechanism of claim 9, wherein the movable connection between the connecting rod and the fastening base is achieved via a rotatable and slidable engagement of a projection of the connecting rod with a guiding slot of the fastening base.

* * * * *